US010113350B2

(12) United States Patent
Brown

(10) Patent No.: US 10,113,350 B2
(45) Date of Patent: Oct. 30, 2018

(54) DOOR STOPPING DEVICE WITH HANDLE

(71) Applicant: Robert Paul Brown, Pittsburg, CA (US)

(72) Inventor: Robert Paul Brown, Pittsburg, CA (US)

( * ) Notice: Subject to any disclaimer, the term of this patent is extended or adjusted under 35 U.S.C. 154(b) by 0 days.

(21) Appl. No.: 15/791,426

(22) Filed: Oct. 24, 2017

(65) Prior Publication Data

US 2018/0142509 A1 May 24, 2018

Related U.S. Application Data

(60) Provisional application No. 62/412,029, filed on Oct. 24, 2016.

(51) Int. Cl.

| | |
|---|---|
| ***E05F 5/02*** | (2006.01) |
| ***E05F 5/06*** | (2006.01) |
| ***E05F 7/00*** | (2006.01) |

(52) U.S. Cl.

CPC . *E05F 5/06* (2013.01); *E05F 7/00* (2013.01)

(58) Field of Classification Search

CPC ..... Y10T 16/61; Y10T 292/71; Y10T 292/73; Y10T 292/34; Y10T 292/15; E05C 17/00; E05C 17/54; E05C 17/025; E05C 19/004; E05C 19/18; E05C 19/182; E05F 5/00; E05F 5/06; E05F 5/02; E05Y 2201/21; E05Y 2201/218; E05Y 2201/224

See application file for complete search history.

(56) References Cited

U.S. PATENT DOCUMENTS

| | | | | | |
|---|---|---|---|---|---|
| 485,613 | A | * | 11/1892 | Deane | E05D 11/1007 16/353 |
| 1,354,046 | A | * | 9/1920 | Lanning | E05C 17/54 16/82 |
| 1,939,402 | A | * | 12/1933 | Moser | E05C 17/54 16/86 A |
| 2,376,117 | A | * | 5/1945 | Bright | E05C 17/54 16/82 |
| 2,898,140 | A | * | 8/1959 | Gislason | E05C 17/54 16/82 |
| 3,328,065 | A | * | 6/1967 | Arenson | E05C 17/54 16/86 A |
| 3,706,112 | A | * | 12/1972 | Newell | E05C 17/54 16/82 |
| 4,114,234 | A | * | 9/1978 | Hogenson | A45C 7/0045 16/114.1 |

(Continued)

FOREIGN PATENT DOCUMENTS

| | | | | | |
|---|---|---|---|---|---|
| DE | 202014000516 U1 | * | 3/2014 | | E05C 17/54 |
| GB | 2183291 A | * | 6/1987 | | E05C 17/54 |
| WO | WO-2008129721 A1 | * | 10/2008 | | E05C 17/54 |

*Primary Examiner* — Chuck Y Mah

(57) ABSTRACT

A door stop device is disclosed. A door stop device comprising a rope with a top portion and a bottom portion, a top rope holder, a bottom rope holder, a first ring, a lockable ring, a wire ring, a foot shaped portion, wherein the top portion of the rope is secured and configured to the top rope holder in such a manner as to form a loop for hanging or attaching the loop around a door handle, wherein the bottom rope holder couples the rope to the first ring, wherein the first ring is linked to the lockable ring, and wherein the lockable ring is linked to the wire ring; and wherein the wire ring is further linked to the foot shaped portion.

4 Claims, 4 Drawing Sheets

(56) References Cited

U.S. PATENT DOCUMENTS 4,688,761 A * 8/1987 Wilcox ..... B25B 27/0035 254/104
5,011,203 A * 4/1991 Tackett ..... E05C 17/54 292/343
5,711,560 A * 1/1998 Gilbertson ..... E05C 17/54 292/343
D433,622 S * 11/2000 Krammer ..... B25B 27/0035 D8/402
6,616,128 B2 * 9/2003 Selzer ..... A62B 3/005 254/104
6,637,077 B2 * 10/2003 Doty ..... B60P 3/079 24/298
D499,958 S * 12/2004 Crane ..... E05C 17/54 D8/402
7,014,229 B1 * 3/2006 Stelmach ..... E05C 17/44 292/342
D556,563 S * 12/2007 Ravinsky ..... E05D 11/1007 D8/402
7,644,964 B2 * 1/2010 Bushey ..... E05C 17/54 16/82
8,967,087 B2 * 3/2015 Church ..... A01K 27/003 119/799
9,085,923 B1 * 7/2015 McWhinney ..... E05C 17/54
2005/0225100 A1 * 10/2005 Pendergrass ..... E05C 17/54 292/343
2010/0242226 A1 * 9/2010 Hopkins ..... E05C 17/54 16/82
2011/0254293 A1 * 10/2011 Duff ..... E05C 17/025 292/343
2014/0007818 A1 * 1/2014 Cheng ..... A01K 27/003 119/792
2014/0084605 A1 * 3/2014 Packer ..... E05C 17/54 292/343
2015/0107532 A1 * 4/2015 Shaver ..... A01K 27/00 119/792

* cited by examiner

DOOR STOPPING DEVICE WITH HANDLE

CROSS-REFERENCE TO RELATED APPLICATIONS

This application claims benefit of priority from U.S. Provisional Application No. 62/412,029, filed Oct. 24, 2016, the contents of which are incorporated herein.

COPYRIGHT & TRADEMARK NOTICES

A portion of the disclosure of this patent document may contain material, which is subject to copyright protection. Certain marks referenced herein may be common law or registered trademarks of the applicant, the assignee or third parties affiliated or unaffiliated with the applicant or the assignee. Use of these marks is for providing an enabling disclosure by way of example and shall not be construed to exclusively limit the scope of the disclosed subject matter to material associated with such marks.

BACKGROUND OF THE INVENTION

The present invention relates to door stopping devices with an integrated attachment handle.

General Background and State of the Art

Door stops (also referred to as "door stopper(s)") are ubiquitous in hotels, hospitals, restaurants and many other establishments, where door stopping devices are used to keep a door open rather than closed.

Door stops generally require its user to bend over and physically insert the stop under the space between a floor surface and a door, followed by a securing of the stop generally by the force of a foot by the user. The routine associated with repeatedly using a door stop is one which can be characterized as strenuous or exhausting and can contribute to poor general health or other chronic or acute pain. Door stops can easily be misplaced, lost or stolen given the nature of its use and lack of attachments associated with them.

There is a need for a door stop that can provide the necessary utility of holding a door open without the harmful effects of its regular use such as having the user bend over to place it and pick it up again. There is also a need for a door stop that can be secured to prevent loss of the door stop and provide a more efficient means of repeated use of such a door stop. The present invention addresses the aforementioned issues by improving upon door stops.

SUMMARY OF THE INVENTION

It is an object of the present invention to provide a door stop device to securely position the door in an opened state without having to require the user to bend over to properly place the door stop.

It is another object of the present invention to provide a door stop device for industrial or heavy duty uses to position the door in an opened state without having to require the user to bend over to properly place the door stop.

In an embodiment, the door stop device comprises a rope with a top portion and a bottom portion, a top rope holder, a bottom rope holder, a first ring, a lockable ring, a wire ring, a foot shaped portion, wherein the top portion of the rope is secured and configured to the top rope holder in such a manner as to form a loop for hanging or attaching the loop around a door handle; wherein the bottom rope holder couples the rope to the first ring, wherein the first ring is linked to the lockable ring; wherein the lockable ring is linked to the wire ring; and wherein the wire ring is further linked to the foot shaped portion.

The first ring can be any ring, such as a key ring, either metal or plastic, but preferably metal for additional security. The first ring can be of any size, but preferably one which proportionally fits the door stop device but preferably smaller than the lockable ring.

In another embodiment, the door stop device comprises a rope with a top portion and a bottom portion, a top rope holder, a connector, a lockable ring, a wedged shaped door stop comprising: a wedge shaped portion; an attachment portion; at least one fastening means; wherein the attachment portion is secured to the wedge shaped portion by the attachment portion on both sides of the wedge shaped portion, wherein the top portion of the rope is secured and configured to the top rope holder in such a manner as to form a loop for hanging or attaching the loop around a door handle, wherein the bottom portion of the rope is linked to the lockable ring by the connector, and wherein the lockable ring links to the attachment portion of the wedge shaped door stop.

In another embodiment, the door stop device comprises a rope with a top portion and a bottom portion, a top rope holder, a connector, a lockable ring, a wedged shaped door stop comprising: a wedge shaped portion; an attachment portion; at least one fastening means; wherein the attachment portion is secured to the wedge shaped portion by the attachment portion on both sides of the wedge shaped portion, wherein the top portion of the rope is secured and configured to the top rope holder in such a manner as to form a loop for hanging or attaching the loop around a door handle, wherein the bottom portion of the rope is linked to the lockable ring by the connector, and wherein the lockable ring links to the attachment portion of one or more of a wedge shaped door stop and foot shaped portion.

DETAILED DESCRIPTION

Figure 1:
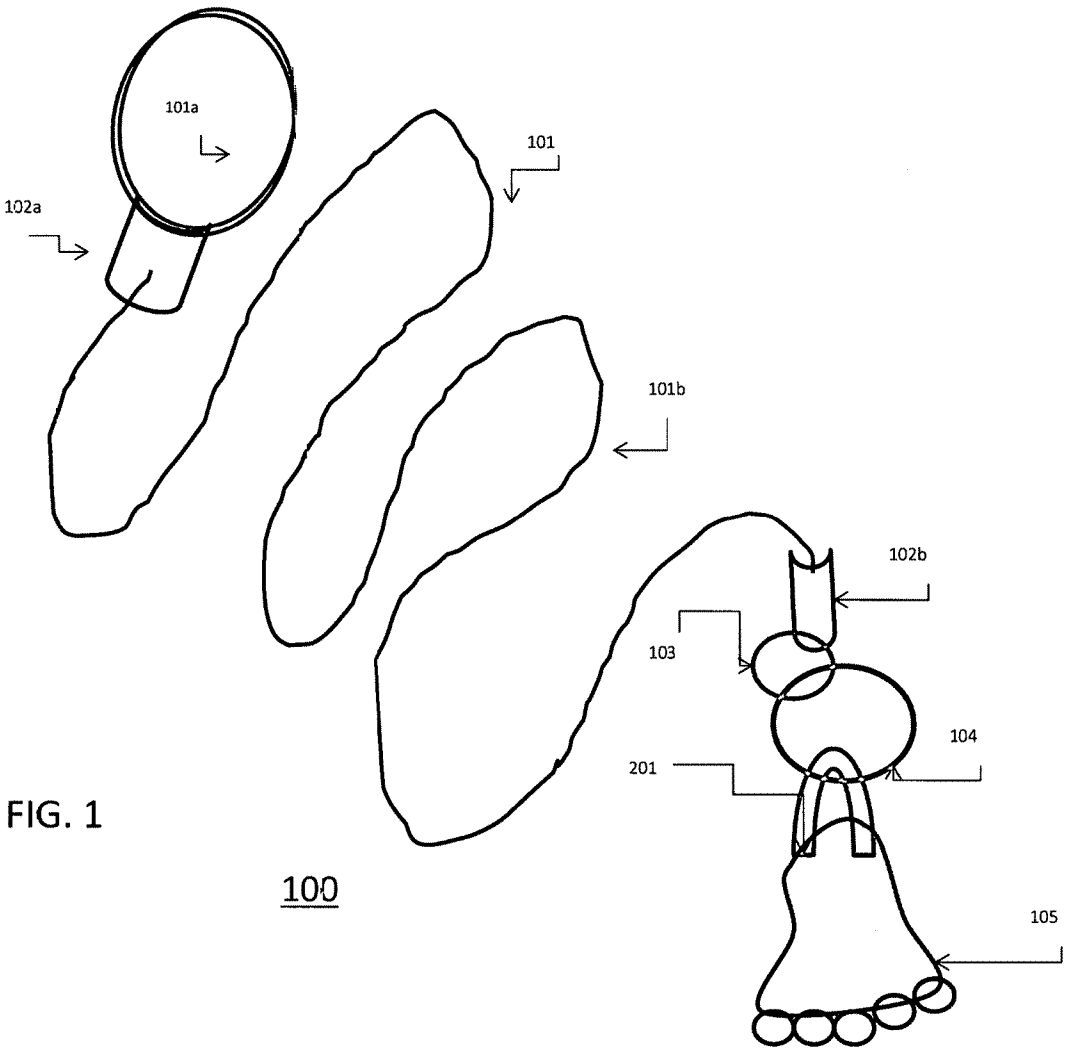
FIG. 1 depicts a perspective view of an embodiment of the door stop device.

FIG. 1 depicts a perspective view of an embodiment of a door stop device 100. In an embodiment, the door stop device 100 comprises a rope 101 with a top portion 101*a* and a bottom portion 101*b*, a top rope holder 102*a*, a bottom rope holder 102*b*, a first ring 103, a lockable ring 104, a wire ring 201, a foot shaped portion 105, wherein the top portion 101*a* of the rope is secured and configured to the top rope holder 102*a* in such a manner as to form a loop for hanging or attaching the loop around a door handle; wherein the bottom rope holder 102*b* couples the rope 101 to the first ring 103, wherein the first ring 103 is linked to the lockable ring 104; wherein the lockable ring 1104 is linked to the wire ring 201; and wherein the wire ring 201 is further linked to the foot shaped portion 105.

The rope 101 can single braided, double braided, hollow, diamond braided, twisted, plaited, and the like. The rope 101 can also be made of a bungee cord or use similar materials to adjust for tensile strength, elasticity, etc. The dimensions of the rope 101 can vary depending on the application of the invention. The rope 101 includes a top portion 101*a* and a bottom portion 101*b*. The length of the rope 101 can be of any length suitable for various types of applications, but approximately 141 centimeters is one preferred length for many types of applications. The material for the rope 101 can be any suitable material for ropes generally, including but not limited to nylon, polyester, polypropylene or high performance fibers such as high modulus polyethylene (HMPE), aramid and the like. In one embodiment, braided polyester is preferred. In another embodiment, the rope 101 can be adjustable through the application of an adjustment strap or other adjustment means.

The top rope holder 102*a* and bottom rope holder 102*b* can be each of a variety of different shapes, materials (i.e., plastic or metal), and configurations. In many embodiments the top rope holder 102*a* can be one with which the dimensions of the loop like configuration of the top portion 101*a* and the dimensions of the bottom portion 101*b* can also be changed.

The first ring 103 can be of a variety of shapes, sizes and configurations depending on the application of the invention. In at least one application, the first ring 103 is smaller in dimensions than the lockable ring 104. The first ring 103 can also be made of non-metal materials (i.e., plastic) depending on the application of the invention.

The lockable ring 104 can be of a variety of shapes, sizes and configurations depending on the application of the invention. The lockable ring 104 can be made of metal or non-metal materials (i.e., plastic) depending on the application of the invention.

Figure 2A:
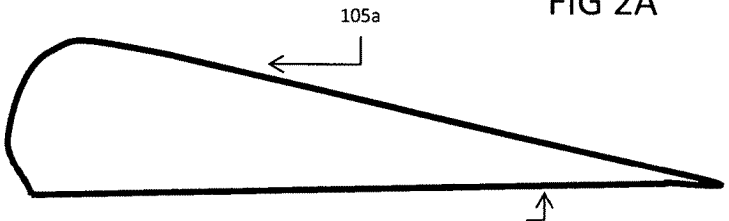
FIGS. 2A-2C depicts various views of an embodiment of the foot shaped portion.
Figure 2B:
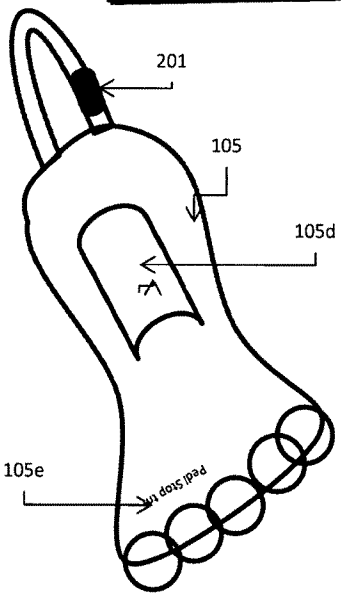
Figure 2C:
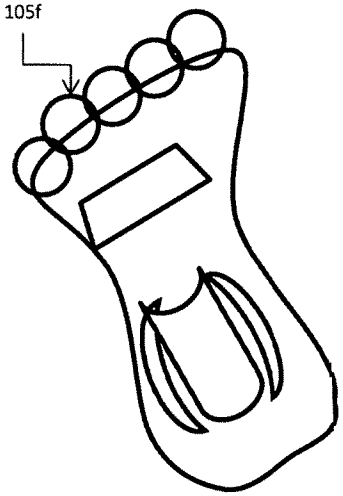

FIGS. 2A-2C depicts various views of an embodiment of a foot shaped portion 105, FIG. 2A shows a side view of the foot shaped portion 105, which further comprise a high portion 105*a* and a low portion 105*b*. FIG. 2B shows a top view of the foot shaped portion 105 showing a top foot portion 105*e*. FIG. 2C shows a bottom view of the foot shaped portion 105 showing a bottom foot portion 105*f*. The foot shaped portion 105 can be made of a variety of materials such as rubber, plastic, or a combination thereof, but rubber is preferred in at least one embodiment and contain only materials that are bisphenol A (BPA) free. The dimensions of the foot shaped portion 105 can vary but in one embodiment, approximately 16.5 cm is preferred in length including that of the wire ring 201 as shown in FIG. 2A, as well as a width of approximately 8 cm and height of the high portion 105*a* to be approximately 3 cm. The foot shaped portion 105 can be of a variety of shapes, sizes and configurations depending on the application of the invention, but in one application, the foot shaped portion 105 can take the shape of a human foot, either left or right, including having a depiction of toenails 105*c* of a human foot. The top foot portion 105*e* of the foot shaped portion 105 can include an outline in approximately the central portion 105*d* of the foot shaped portion 105, while the bottom foot portion 105*f* can have outlines of various shapes and dimensions and can be hollow, without any material within those outlines, as depicted in FIG. 2C.

The wire ring 201 can be made of a variety of materials, including metal, plastic, or a combination thereof. The dimensions of the wire ring 201 can vary depending on the application of the invention, although 6 inches in length would be preferred in one embodiment.

The fastening means 307 can include one or more screws, hooks, fasteners, clips, buckles, and the like. Multiple fastening means 307 can be used depending on the application of the invention. A variety of different configurations can be used in applying fastening means 307 to any portion of the wedge shaped portion 301 or the foot shaped portion 105.

The foot shaped portion 105 can be made of a variety of materials such as rubber, plastic, or a combination thereof, but rubber is preferred in at least one embodiment and contain only materials that are bisphenol A (BPA) free. The dimensions of the toot shaped portion 105 can vary but in one embodiment, approximately 16.5 cm is preferred in length including that of the wire ring 201 as shown in FIG. 2A, as well as a width of approximately 8 cm and height of the heel portion to be approximately 3 cm. The foot shaped portion 105 can be of a variety of shapes, sizes and configurations depending on the application of the invention, but in one embodiment, the foot shaped portion 105 can take the shape of a human foot, including having depicting the toenails of a human foot. The top foot portion 105*e* of the foot shaped portion 105 can include an outline in approximately the central portion 105*d* of the foot shaped portion 105, while the bottom portion 105*b* of the foot shaped portion 105 can have outlines of various shapes and dimension and that are hollow, without any material within those outlines.

In one embodiment, the foot shaped portion 105 can be referred to as a door stop portion, which departs from the foot shape of the foot shaped portion of 105 and allows for the present invention to be of a variety of shapes, sizes and configurations depending on the application of the invention.

Figures 3A, 3B, 3C:
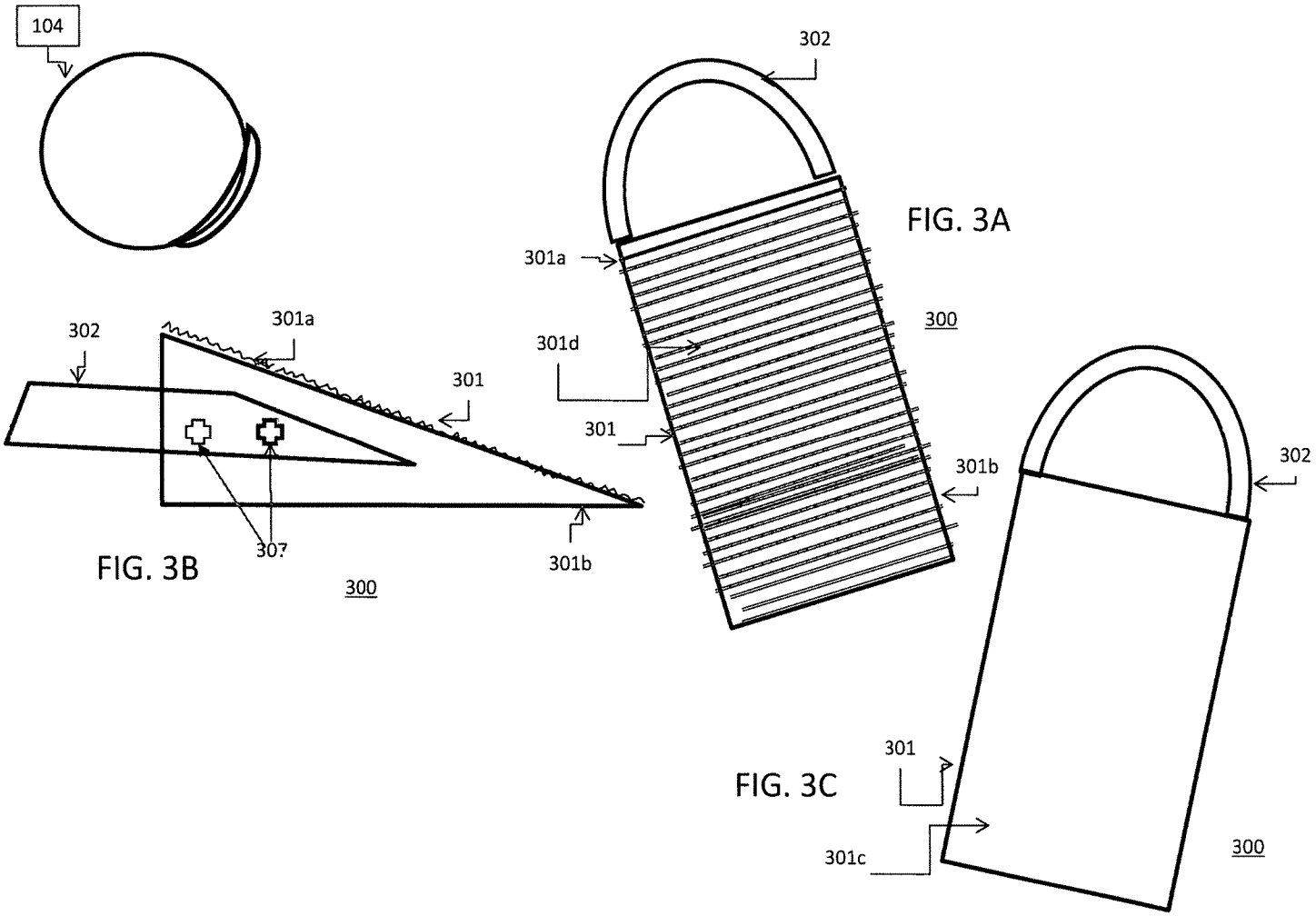
FIGS. 3A-3C depict views of an embodiment of a wedge shaped device.

FIGS. 3A-3C depict views of an embodiment of a wedge shaped device 300. FIG. 3A depicts a top view of an embodiment of the wedge shaped device 300. FIG. 3B depicts a side view of an embodiment of the wedge shaped device 300. FIG. 3C depicts a bottom view of an embodiment of the wedge shaped device 300. The wedge shaped portion 301 of the wedge shaped device 300 can be made of a variety of materials such as rubber, plastic, or a combination thereof, but rubber is preferred in at least one embodiment. In another embodiment, the wedge shaped portion 301 contains only materials that are bisphenol A (BPA) free. The dimensions of the wedge shaped portion 301 can vary but in one embodiment, approximately 5 cm is preferred in width and 12.5 cm in length including that of the attachment portion 302 as shown in FIG. 3B. The wedge shaped portion 301 can be of a variety of shapes, sizes and configurations depending on the application of the invention, but in one embodiment, the wedge shaped portion 301 can take the shape of a wedge, including having a high wedge portion 301*a* and a low portion 301*b*. The angle between the bottom surface 301*c* and the low wedge portion 301*b* can vary among a plurality of embodiments of the wedge shaped portion 301. The top surface 301*d* of the wedge shaped portion 301 can have shapes and configurations that vary, and in one embodiment, can have an irregular surface, or a surface with ridges of different shapes, sizes, and configurations in order to improve the grip to hold the door in the desired position. The bottom surface 301*c* of the wedge shaped portion 301 can have shapes and configurations that vary, and in one embodiment, can have a smooth surface, or an irregular surface, or a surface with ridges of different shapes, sizes, and configurations in order to better hold the door in the desired position.

The attachment portion 302 can be of a variety of shapes, sizes and configurations depending on the application of the invention, but in one embodiment, it is preferred to be in a U-shape made of metal, with each tip of the attachment portion narrowing with the increasing amount of overlap in contact between attachment portion 302 and the wedge shaped portion 301 as shown in FIG. 3B. The attachment portion 302 can be made of a variety of materials such as metal, plastic, or a combination thereof, but metal is preferred in at least one embodiment. The dimensions of the attachment portion 302 can vary but in one embodiment, approximately 16.5 cm is preferred in length including that of the wire ring 201 as shown in FIG. 2A, as well as a width of approximately 8 cm and height of the heel portion to be approximately 3 cm.

Figure 4:
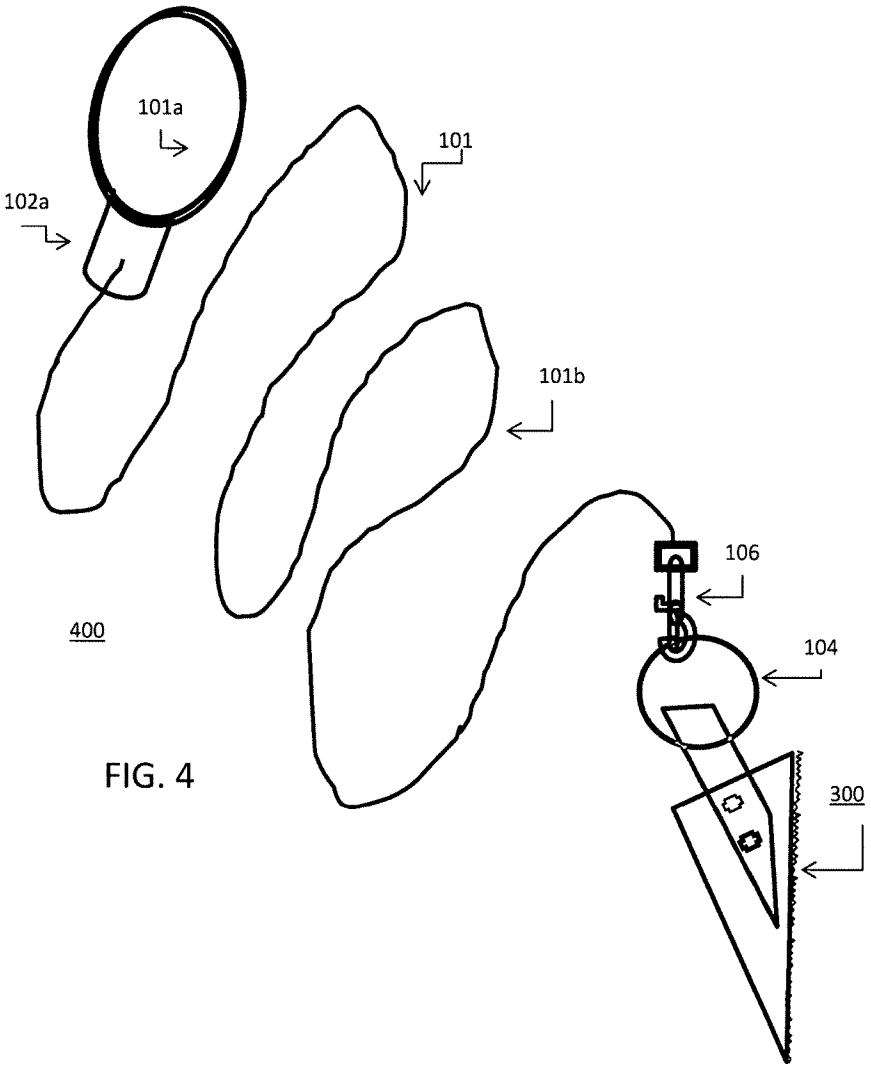
FIG. 4 depicts a perspective view of another embodiment of a door stop device.

FIG. 4 depicts a perspective view of another embodiment of a door stop device 400. As shown in FIG. 4, the door stop device comprises a rope 101 with a top portion 101*a* and a bottom portion 101*b*, a top rope holder 102*a*, a connector 106, a lockable ring 104, a wedged shaped device 300 comprising: a wedge shaped portion 301; an attachment portion 302; at least one fastening means 307; wherein the attachment portion 302 is secured to the wedge shaped portion 301 by the attachment portion 302 on both sides of the wedge shaped portion 301, wherein the top portion 101*a* of the rope is secured and configured to the top rope holder 102*a* in such a manner as to form a loop for hanging or attaching the loop around a door handle, wherein the bottom portion 101*b* of the rope is linked to the lockable ring 104 by the connector 106, and wherein the lockable ring 104 links to the attachment portion 302 of the wedge shaped device 300 or the wire ring 201 of the toot shaped portion 105.

In yet another embodiment, the door stop device 100 or device 400 can be associated with or linked to one or more of: electronic circuitry, robotics, electronic or electrical components, displays, sensors, computer processors, mobile devices, I/O, memory, power supplies, lights, LEDs, and the like. In some embodiments, buckles, straps, and the like can be used to adjust the length of the rope 101 and in yet other embodiments, such control for the length of the rope can be achieved by a combination of the aforementioned electronics or electrical components, displays, sensors, computer processors, and the like.

In another embodiment, the door stop device can be configured to include one or more force or pressure or other sensors to measure the force or pressure or other measurements in order to indicate that the door stop device is fully secure under a given door, wherein the fully secure position can be indicated to a user of the device by a light.

Closing Remarks

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The teams "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While the invention has been described in detail with reference to disclosed embodiments, various modifications within the scope of the invention will be apparent to those of ordinary skill in this technological field. It is to be appreciated that features described with respect to one embodiment typically can be applied to other embodiments.

The invention can be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

Although exemplary embodiments have been provided in detail, various changes, substitutions and alterations could be made thereto without departing from spirit and scope of the disclosed subject matter as defined by the appended claims. Variations described for the embodiments may be realized in any combination desirable for each particular application. Thus particular limitations and embodiment enhancements described herein, which may have particular advantages to a particular application, need not be used for all applications. Also, not all limitations need be implemented in methods, systems, and apparatuses including one or more concepts described with relation to the provided embodiments. Therefore, the invention properly is to be construed with reference to the claims.

I claim:

1. A the door stop device comprising:
a rope with a top portion and a bottom portion;
a top rope holder;
a connector;
a lockable ring;
a wedged shaped device comprising:
a wedge shaped doorstop portion;
an attachment portion;
at least one fastening means;
wherein the attachment portion is secured to the wedge shaped portion by the fastening means on both sides of the wedge shaped doorstop portion,
wherein the top portion of the rope is secured and configured to the top rope holder in such a manner as to form a loop for hanging or attaching the loop around a door handle,
wherein the bottom portion of the rope is linked to the lockable ring by the connector, and
wherein the lockable ring links to the attachment portion of the wedge shaped device.

2. A door stop device comprising:
a rope with a top portion and a bottom portion;
a top rope holder, a bottom rope holder;
a first ring;
a lockable ring;
a wire ring;
at least one foot shaped doorstop portion;
wherein the top portion of the rope is secured and configured to the top rope holder in such a manner as to form a loop for hanging or attaching the loop around a door handle,
wherein the bottom rope holder couples the rope to the first ring, wherein the first ring is linked to the lockable ring, and
wherein the lockable ring is linked to the wire ring; and wherein the wire ring is further linked to the foot shaped doorstop portion.

3. The door stop device of claim 2 wherein the wire ring is linked to one or more of said at least one foot shaped doorstop portion.

4. The door stop device of claim 1 wherein the rope is guided through at least one adjustable strap.

* * * * *